US005728433A

United States Patent [19]

Cheng et al.

[11] Patent Number: 5,728,433

[45] Date of Patent: Mar. 17, 1998

[54] METHOD FOR GOLD REPLENISHMENT OF ELECTROLESS GOLD BATH

[75] Inventors: Tien-Jen Cheng, Bedford, N.Y.; David B. Shields, San Diego, Calif.

[73] Assignee: Engelhard Corporation, Iselin, N.J.

[21] Appl. No.: 808,694

[22] Filed: Feb. 28, 1997

[51] Int. Cl.[6] ..... B05D 1/18

[52] U.S. Cl. ..... 427/437; 477/443.1; 477/443.2

[58] Field of Search ..... 427/437, 443.1, 427/443.2

[56] References Cited

U.S. PATENT DOCUMENTS

| | | | |
|---|---|---|---|
| 3,700,469 | 10/1972 | Okinaka | 106/1 |
| 3,847,649 | 11/1974 | Sova | 117/47 A |
| 3,962,494 | 6/1976 | Nuzzi | 427/304 |
| 3,993,808 | 11/1976 | Inaba et al. | 427/377 |
| 4,009,297 | 2/1977 | Redmond et al. | 427/54 |
| 4,144,090 | 3/1979 | Franz | 134/3 |
| 4,337,091 | 6/1982 | El-Shazly et al. | 106/1.23 |
| 4,340,451 | 7/1982 | Okinaka et al. | 204/46 |
| 4,481,035 | 11/1984 | Andrascek et al. | 106/1.23 |
| 4,863,766 | 9/1989 | Iacovangelo et al. | 427/443.1 |
| 4,919,720 | 4/1990 | Stavitsky | 106/1.26 |
| 4,978,559 | 12/1990 | Iacovangelo | 427/443.1 |
| 5,130,168 | 7/1992 | Mathe et al. | 427/443.1 |
| 5,258,062 | 11/1993 | Nakazawa et al. | 106/1.23 |
| 5,338,343 | 8/1994 | Kroll et al. | 106/1.23 |

FOREIGN PATENT DOCUMENTS

| | | | |
|---|---|---|---|
| 0 699 778 A1 | 3/1996 | European Pat. Off. | C23C 18/42 |

OTHER PUBLICATIONS

Okinaka, Y., Electroless Gold Deposition Using Borohydride or Dimethylamine Borane as Reducing Agent, Paper presented at the 57th Annual Convention, American Electroplaters' Society, Montreal, Quebec, Canada, Jun. 25, 1970.

Ohtsuka, Kuniaki et al, Electroless Gold Plating Solution, Paper, given at Printed Circuit World Convention 5, Glasgow, Jun. 1990.

*Primary Examiner*—Benjamin Utech

*Attorney, Agent, or Firm*—Ronald G. Ort

[57] ABSTRACT

A method for replenishing an electroless gold plating bath in which metallic gold is dissolved into the bath.

10 Claims, No Drawings

METHOD FOR GOLD REPLENISHMENT OF ELECTROLESS GOLD BATH

BACKGROUND OF THE INVENTION

1. Field of the Invention

This invention relates to an improved process for the chemical deposition of gold from a gold cyanide bath by non-electrolytic methods in which the gold salts are replenished from metallic gold without the need for adding additional cyanide.

2. Description of Related Art

The deposition of gold by non-electrolytic methods is well known. Generally such methods concern autocatalytic reduction of gold salts soluble in an alkaline medium. The reduction is carried out in the presence of a stabilizing agent in order to avoid a spontaneous liberation of gold at ambient temperatures. Such baths may comprise potassium gold cyanide ($KAu(CN)_2$) as the source of the gold for deposition.

Okinaka, U.S. Pat. No. 3,700,469, issued Oct. 24, 1972, is an early reference describing electroless gold plating baths. As discussed in that patent and in Okinaka, Plating, 57, 914 (1970), in an electroless gold plating solution, gold is deposited from a bath with suitable compositions and process conditions according to the following reactions:

$$BH_3OH^- + 3Au(CN)_2^- + 3OH^- \leftrightharpoons BO_2^- + \tfrac{3}{2} H_2 + 2H_2O + 3Au + 6CN^- \quad (1)$$

$$(CH_3)_2NHBH_3 + OH^- \leftrightharpoons (CH_3)_2NH + BH_3OH^- \quad (2)$$

In the above reactions, solid gold is plated through the oxidation of a reducing agent dimethylamine borane (DMAB) which generates $BH_3OH^-$ through reactions with $OH^-$ or $H_2O$. Generally, a metal catalyst is needed to promote the reaction, and in this manner the gold only deposits on the catalytic metallic surfaces. Gold itself is an effective catalyst for the electroless deposition of additional gold, and such depositions may be referred to as an autocatalytic reduction process. In one process, a metal layer is first deposited on those areas on which gold is to be deposited to initiate the autocatalytic electroless deposition. This may be done by various well-known processes, such as screen printing. Then gold is deposited on the surface, and the gold at the surface autocatalyzes further deposition.

During the electroless gold plating process, in accordance with the chemical process set forth in Equation (1) above, as one gold atom plates out from the gold cyanide complex, two free cyanide ions are produced as by-products. As a result, the cyanide concentration becomes higher and higher. It has been found that as the free cyanide concentration increases, the plating reaction rate decreases, eventually to the point of stopping.

Prost-Tournier et al., U.S. Pat. No. 4,307,136, incorporated herein by reference, teaches a process for the non-electrolytic chemical deposition of gold by autocatalytic reduction, and includes a detailed discussion of the chemistry of such gold deposition.

In the conventional operation of an electroless gold plating process, the depletion of reactants and the generation of by-products are inevitable. The reaction rate and performance rate are therefore often inconsistent. The gold cyanide, reducer and hydroxide consumed in reaction are relatively easy to replenish, by simply adding the needed amount of chemicals to the bath. However, it is more difficult to balance the free cyanide which helps in stabilizing the bath. A result of the gold cyanide reduction process is that as the plating progresses the concentration of free cyanide ions in the bath increases, and this lowers the gold deposition rate. The bath is usually discarded when a too low plating rate is detected. Discarding the bath can result in a significant loss of gold and other chemicals, even after performing recovery through reclaim processes. A big expense is usually also required for cyanide waste treatment.

Standard electroless gold plating baths contain many chemicals, showing strong alkalinity, high free cyanide concentration and strong reducing capability. Therefore, it is difficult to remove free cyanide from a used electroless gold bath where cyanide is too high to continue plating without changing some of the chemistry or leaving some other chemicals behind. For example, Inaba et al, U.S. Pat. No. 3,993,808 describes a method which includes adding zinc chloride or nickel chloride to remove free cyanide from electroless gold plating solutions. However, such a process would alter the chemistry of the bath, forming zinc or nickel cyanide complex salts which remain in the bath. Iacovangelo et al, U.S. Pat. No. 4,863,766 also proposes to add nickel salts (for example, nickel acetate) to form nickel cyanide complex salts to control cyanide activity in an electroless gold bath. However, this process also results in the buildup of nickel contaminants in the bath.

Okinaka et al, U.S. Pat. No. 4,340,451 describes a method for replenishing gold in an electroplating bath by circulating the plating solution through an AuCN-containing vessel. The plating solution contains sufficient free cyanide to render the gold soluble by producing soluble $Au(CN)_2^-$ ions. However, according to the mass balance of the system, the amount of free cyanide will continue building up as more $CN^-$ ions are released. Although Okinaka uses one cyanide ion to solubilize gold form AuCN, this still leaves behind one of the two cyanide ions generated in gold cyanide reduction. Although this may be suitable for the electrolytic plating process of Okinaka, the chemistry of an electroless gold plating bath is quite different. In an electroless plating bath, a continued increase in the $CN^-$ ion content eventually renders the bath unsuitable for plating.

SUMMARY OF THE INVENTION

As discussed above, it has been observed that as an electroless plating process progresses, the $CN^-$ ion content increases, causing the plating rate to decrease. Under certain conditions, the plating reaction according to Equation (1) was actually found to reverse itself and cause gold to be stripped from the workpiece and back into solution. The present invention takes advantage of this stripping process and is a method to replenish the gold in an electroless plating solution by dissolving gold from a solid metallic gold source into the plating solution. That is, the replenishment of the electroless gold plating bath is accomplished by reversing the plating equation to cause the dissolution of gold from a metallic source.

For a cyanide autocatalytic reduction process as described above in accordance with Equation (1), the dissolution of metallic gold is believed to proceed in accordance with the following simplified equation:

$$4Au + 8CN^- + 2H_2O + O_2 \leftrightharpoons 4Au(CN)_2^- + 4OH^- \quad (3)$$

In an electroless gold plating process, in accordance with Equation (1) above, the reverse reaction by Equation (3) is generally not significant. The deplating or dissolution of gold is relatively minimal at low free cyanide concentration. However, in accordance with the present invention it was found that the dissolution of gold into the plating solution can be promoted by establishing proper conditions in the bath.

The conditions which promote gold dissolution may vary with different types of plating baths. For a cyanide autocatalytic reduction process as described above, a high free cyanide concentration was found to be one condition which promotes dissolution of gold. Lower bath temperatures were also found to promote the dissolution process. It was also found that directing a stream of air to impinge on the surface of the gold promoted dissolution of the metallic gold into the bath solution.

The gold dissolution reaction of Equation (3) also appears to be promoted by strong agitation of the gold relative to the bath. This may be accomplished by agitating the bath, the metallic gold source, or both. Such agitation may promote the dissolution of gold by decreasing the concentration of adsorbed gold ions on the metallic gold surface.

DESCRIPTION OF THE PREFERRED EMBODIMENT

The present invention is directed to a method for replenishing the gold in a plating bath for electrolessly depositing gold onto a workpiece, where the plating process is in accordance with a reversible chemical reaction. In one embodiment, the plating solution contains dissolved gold cyanide ions and excess free cyanide. In such a bath, the dissolution of gold is believed to proceed in accordance with Equation (3) above. For a cyanide autocatalytic reduction process as described above, a high free cyanide concentration was found to be one condition which promotes dissolution of gold. To replenish the gold in the bath, a source of replenishment metallic gold is immersed in the bath solution. This can be accomplished by placing a metallic gold source into the baths or by flowing the bath over the gold source. Under the proper conditions, this process causes gold to be dissolved from the source of metallic gold to form gold cyanide ions in the plating solution.

Among the conditions which favor the dissolution of solid gold metal into an electroless gold bath are the following:

1) Lowering the operating temperature of the electroless gold bath.

2) Directing a strong stream of air or other oxygen-containing gas to impinge on the gold metal.

3) Agitating the solution at the gold surface, either by agitating the solution or vigorous movement of the gold metal.

4) Increasing the effective surface area of the gold source.

In accordance with a first embodiment of the method of the present invention, the replenishment is accomplished by a batch process. When it is desired to replenish the gold in the electroless gold plating bath, any workpiece on which gold is being deposited is first removed from the bath. Then a source of replenishment metallic gold is immersed in the bath, under conditions which promote the dissolution of the gold into the solution. Preferably, a stream of air or other oxygen-containing gas is directed at gold to promote dissolution. In addition, the solution at the gold surface should be agitated, either by agitating the solution or by vigorous movement of the gold metal. Lowering the temperature of the bath was also found to promote the dissolution process.

In a further embodiment, the replenishment can be accomplished in a batch process without the need to remove the workpiece from the solution. In such a process, the replenishment gold source is positioned in the bath away from the workpiece. Then a stream of air is directed at the replenishment gold, which is also preferably subjected to vigorous movement to cause surface agitation of the surrounding bath solution. This is conducted while the workpiece is maintained in a relatively calm section of the bath, to minimize dissolution of gold from the workpiece.

In another embodiment of the present invention, the replenishment is accomplished by a continuous or intermittent process, which can proceed without interrupting the plating operation. A side stream of the bath solution is directed into a separate replenishment vessel in which a source of replenishment metallic gold is immersed in the solution. As above, preferably a stream of air is directed at the metallic gold and the gold is agitated to promote the dissolution of the gold into the solution. Preferably, the temperature in the replenishment bath is lower relative to that in the plating bath, to promote the dissolution of the metallic gold. This can be achieved by providing a means for cooling the replenishment bath, such as circulating a coolant through a cooling coil in contact with the bath, as would be well known to one skilled in the art. The replenished solution is then directed back into the plating bath.

The source of replenishment gold can be a solid gold object, but preferably is in the form of a gold coated substrate. In the examples, gold coated, platinum clad titanium mesh was used as the source of gold. It is desirable to provide the gold in a form which presents a high surface area in order to achieve a desired replenishment rate. The gold can also be in the form of a packed column, or similar structure, through which the bath which is to be replenished is circulated.

In the following examples of the present invention, a stream of air was directed at the surface of the replenishment gold to promote dissolution. It is believed that other oxygen-containing gases could also be used to promote dissolution. The replenishment gold was in the form of a coated mesh on a mechanized rack which was connected to a motor such that as the motor rotated, the rack moved up and down, thus agitating the mesh in the bath. The tank included a heater which was set to 75° C. during plating. During the replenishment cycle, the set point on the heater was lowered to 50° C., and the bath cooled to that temperature over time.

EXAMPLE 1

The gold plating and bath replenishment rate and performance were evaluated by plating cofired ceramic pin grid arrays (PGAs) in an electroless gold bath. Dummy platings were done using Kovar® nickel alloy (INCO) coupons to deliberately consume gold in the bath. Replenishment was accomplished by stripping or deplating gold from a solid gold source into the bath solution. Platinum clad titanium mesh was electrolytically gold plated and used as the replenishment solid gold source. The purity of the solid gold was determined to be at least 99.99%. Air agitation was applied underneath the mesh, which was undergoing up-and-down movement facilitated by a mechanized rack arrangement. The concentrations of gold cyanide and free cyanide were monitored by titration during the dummy plating and replenishment, i.e. stripping, processes. Before each formal plating on PGAs for evaluation, the bath was replenished for reducer and hydroxide. Replenishment by the deplating of solid gold into dissolved gold cyanide was accomplished by a batch process, in which the PGAs and dummy plating coupons were removed from the bath and the replenishment mesh immersed. The plating and replenishment rates were approximately the same. In Table 2, the conditions are given for plating steps and for the deplating, i.e. replenishment, steps.

TABLE 1

Plating Bath Composition

| Chemicals | Concentration (g/l) |
|---|---|
| $Au(CN)_2^-$ | 4.0 |
| DMAB | 8.0 |
| KOH | 35.0 |
| KCN | 2.9 |

TABLE 2

Plating and Deplating Conditions

| Conditions | Plating | Deplating |
|---|---|---|
| temperature | 75° C. | 50° C. |
| air agitation | 1.25 LPM | 2.0 LPM |
| rack movement | 50 rpm | 60 rpm |

Before and after the replenishment, the weight of the platinum mesh was measured to determine the rate and efficiency of the gold deplating. The PGAs were visually inspected to ensure the coverage of gold on all metallized areas. Gold plating rate was determined by measuring the gold thickness using X-ray fluorescence after a one-hour plating time. The results are shown in Table 3.

TABLE 3

Test Results

| Event | Au (g/l) | KCN (g/l) | Au (g) consumed | Au (g) replen. | Plating rate (μ"/hr) |
|---|---|---|---|---|---|
| bath makeup | 4.0 | 2.9 | | | 70 |
| lst plating | | | | | |
| after dummy plating | 2.8 | 4.0 | 1.9 | | |
| deplating | | | | 1.9 | |
| after deplating | 4.0 | 2.9 | | | |
| plate PGAs | | | | | 70 |
| after dummy plating | 1.2 | 5.4 | 4.2 | | |
| deplating | | | | 4.2 | |

TABLE 3-continued

Test Results

| Event | Au (g/l) | KCN (g/l) | Au (g) consumed | Au (g) replen. | Plating rate (μ"/hr) |
|---|---|---|---|---|---|
| after deplating | 4.0 | 3.0 | | | |
| plate PGAs | | | | | 68 |

It is seen that as the gold plated out of solution, the free cyanide concentration went up. The replenishment process worked successfully in lowering the free cyanide concentration while increasing the gold cyanide concentration to the preset value. A visual inspection showed consistent performance of the plating, with complete coverage and no visible excess plating on any unmetallized areas.

What is claimed is:

1. A method for replenishing an electroless gold plating bath comprising dissolving metallic gold into the bath.

2. The method of claim 1 wherein the plating bath includes cyanide ions.

3. The method of claim 2 wherein the plating bath includes dissolved gold cyanide ions and excess free cyanide ions.

4. The method of claim 1 wherein the step of dissolving the metallic gold comprises directing a stream of air onto the gold.

5. The method of claim 1 wherein the metallic gold is provided in the form of a gold coated substrate.

6. The method of claim 1 wherein the plating bath is contained in a plating tank, and the metallic gold is immersed into the bath in the plating tank.

7. The method of claim 1 wherein the plating bath is contained in a plating tank, and a portion of the plating bath is circulated to a separate replenishment vessel containing the metallic gold.

8. The method of claim 1 wherein a stream of air is directed onto the metallic gold to promote its dissolution into the plating bath.

9. The method of claim 1 wherein the metallic gold and plating bath are agitated relative to each other to promote the dissolution of the gold into the plating bath.

10. The method of claim 1 wherein the temperature of the plating bath is lowered to promote the dissolution of the metallic gold.

* * * * *